United States Patent [19]

Lambertsen et al.

[11] Patent Number: 4,807,706

[45] Date of Patent: Feb. 28, 1989

[54] BREATHABLE FIRE EXTINGUISHING GAS MIXTURES

[75] Inventors: Christian J. Lambertsen, Ardmore; Joseph G. Santangelo, Allentown, both of Pa.

[73] Assignee: Air Products and Chemicals, Inc., Allentown, Pa.

[21] Appl. No.: 80,507

[22] Filed: Jul. 31, 1987

[51] Int. Cl.[4] ..... H62C 1/00

[52] U.S. Cl. ..... 169/45; 169/46; 252/605

[58] Field of Search ..... 169/45, 46, 11, 66, 169/60; 252/605; 244/163

[56] References Cited

U.S. PATENT DOCUMENTS

| | | | |
|---|---|---|---|
| 1,406,479 | 2/1922 | Muchka | 252/605 |
| 1,926,396 | 9/1933 | Midgley et al. | 23/12 |
| 3,351,562 | 11/1967 | Taylor | 244/163 |
| 3,486,562 | 12/1969 | Goodloe et al. | 169/11 |
| 3,715,438 | 2/1973 | Huggett | 424/366 |
| 3,822,207 | 7/1974 | Howard et al. | 252/8 |
| 3,840,667 | 10/1974 | Huggett | 424/366 |
| 3,844,354 | 10/1974 | Larsen | 252/8 |
| 3,893,514 | 7/1975 | Carhart et al. | 169/46 |
| 4,446,923 | 5/1984 | Martin | 169/45 |
| 4,681,602 | 7/1987 | Glenn et al. | 55/389 |

FOREIGN PATENT DOCUMENTS

| | | | |
|---|---|---|---|
| 955946 | 9/1982 | U.S.S.R. | 169/45 |
| 1110457 | 8/1984 | U.S.S.R. | 169/45 |

*Primary Examiner*—Sherman D. Basinger
*Assistant Examiner*—Thomas J. Brahan
*Attorney, Agent, or Firm*—Willard Jones, II; James C. Simmons; William F. Marsh

[57] ABSTRACT

A process for safely preventing, controlling and/or extinguishing fires in confined spaces without damage to equipment, loss of habitability for personnel, loss of consciousness for personnel or a significant impact on the mental acuity of personnel in the confined space, which comprises introducing carbon dioxide and another inert gas, e.g. nitrogen or helium, to the confined space to lower the oxygen content to a concentration in the range between 8% and 15% by volume while increasing the carbon dioxide content of the confined space to an amount in the range of 2% to 5% by volume. The combination of reducing oxygen concentration and increasing carbon dioxide concentration in the gaseous enviornment of the confined space works together to sustain mammalian life, in particular, maintaining consciousness and mental acuity while not supporting, i.e. extinguishing, flame.

6 Claims, 11 Drawing Sheets

FLAME EXTINGUISHED ( >20 SEC.)
ATM: 12% O2 - 0% CO2
ATM: 10% O2 - 0% CO2
ATM: 8% O2 - 0% CO2
ATM: 6% O2 - 0% CO2
PERCENTAGE OF RATS CONTINUING WALKING PRIOR TO REACHING STAGE 3
100
80
60
40
20
0
0
5
10
15
20
25
30
35
40
TIME (MINUTES)

BREATHABLE FIRE EXTINGUISHING GAS MIXTURES

TECHNICAL FIELD

This invention relates to the prevention, control and extinguishing of fires in confined spaces and, more particularly, to the control and extinguishing of fires without damage to equipment while maintaining a suitable environment for effective personnel activity in an emergency.

BACKGROUND OF THE INVENTION

Several solutions to the problem of extinguishing fires in confined spaces where mammalian life, in particular, human life, is present are know in the prior art. Basically, these solutions revolve around producing a habitable yet combustion suppressant atmosphere is the confined space.

U.S. Pat. No. 3,715,438 discloses a habitable atmosphere, which does not sustain combustion of flammable materials of the non-self-sustaining type and which is capable of sustaining mammalian life, consisting essentially of air; a perfluoroalkane selected from the group consisting of carbon tetrafluoride, hexafluoroethane, octafluoropropane, and mixtures thereof; and makeup oxygen in an amount from about 0 to the amount required to provide, together with the oxygen present in the air, sufficient total oxygen to sustain mammalian life. The perfluoroalkane should be present in an amount sufficient to impart to the atmosphere a heat capacity per mol of total oxygen which is sufficient to suppress combustion of the flammable materials present in the enclosed compartment containing the atmosphere. The patent also discloses a method for preventing and controlling fire in combined air-containing compartment while maintaining the compartment habitable by mammalian life, which comprises, introducing into the air carbon tetrafluoride, hexafluoroethane, octafluoropropane or mixtures thereof, in an amount sufficient to provide a heat capacity per mol of total oxygen which is sufficient to suppress combustion of the flammable materials present in the compartment and, additionally, introducing oxygen if and as required, to make up with the oxygen available in the air sufficient total oxygen to sustain mammalian life.

U.S. Pat. No. 3,840,667 discloses an oxygen-containing atmosphere which will not support combustion but will sustain mammalian life. The oxygen-containing atmosphere comprises a mixture of sufficient oxygen to sustain mammalian life; an inert, stable, high heat capacity of polyatomic (a perfluoroalkane) gas in an amount which provides the oxygen-containing atmosphere with a total heat capacity per mol of oxygen of at least 40 calories per °C. measured at 25° C. and constant pressure; and helium in an amount of from about 5% to the balance up to 100%. All percentages are in mol%. The atmosphere disclosed in the patent claims to be useful in sustaining mammalian life within any closed system wherein fire hazards would normally be present.

U.S. Pat. No. 3,893,514 discloses a system and method of adding nitrogen under pressure to a confined area including a habitable atmosphere to suppress a fire without any deleterious effect on humans within the environment in which the fire is suppressed. In adding nitrogen to the confined area, the partial pressure of oxygen remains the same for human life, if necessary, whereas the percent by volume oxygen is lowered to a point which is not sufficient to support combustion of burning elements. Therefore, life is sustained while the fire is suppressed without any harmful effect on humans.

Other processes and gas for extinguishing fires are taught by the following:

U.S. Pat. No. 1,926,396 discloses a process for arresting or extinguishing a flame which comprises directing into the atmosphere in the neighborhood of the flame a halogen derivative of a hydrocarbon-containing fluoride, an example being dichlorodifluoromethane.

U.S. Pat. No. 3,486,562 discloses an apparatus for detecting and extinguishing a fire in an enclosed environment. When a preselected temperature is reached in the enclosed environment, a heat sensor activates the means for evacuating the gaseous contents of the enclosed environment to an accumulator which is at a much lower pressure than the enclosed environment. At the same time, means are provided for cutting off air and power to the enclosed environment, while nitrogen is being introduced to the enclosed environment in place of the evacuated gases.

U.S. Pat. No. 3,822,207 discloses a fire-fighting composition. Chloropentafluorethane is a general purpose fire extinguishing agent of low toxicity. In a mixture with other halogenated alkanes, especially bromochlorodifluoromethane and bromotrifluoromethane, very effective extinguishing compositions may be made giving low concentrations of breakdown products in use against liquid fuel fires.

U.S. Pat. No. 3,844,354 also discloses chlorpentafluoroethane as an efficient and economic fire extinguishing agent for total flooding systems.

SUMMARY OF THE INVENTION

The present invention relates to a method for preventing, controlling and extinguishing fires in a confined atmospheric space (an atmospheric space is one containing a gas mixture which will support animal life) while maintaining the confined space habitable for mammalian life, in particular, human life. The process of the present invention comprises introducing in the confined space an effective amount of extinguishing gas comprising carbon dioxide and another inert gas which is not toxic itself nor will decompose at combustion temperatures to produce toxic gases, e.g. nitrogen or helium, so as to lower the oxygen content of the confined space from its initial ambient concentration to an amount which does not support combustion, however, does support life, e.g. 8% to 15% oxygen by volume and preferably 10% to 12% oxygen by volume, and increase the carbon dioxide content of the confined space from its initial ambient concentration to an amount which increases brain blood flow and brain oxygenation, e.g. 2% to 5% $CO_2$ by volume, thereby sustaining consciousness without producing incapacitating dyspnea. The extinguishing gas of the present invention can further comprise a polyatomic gas having a high heat capacity.

A BRIEF SUMMARY OF THE FIGURES

DETAILED DESCRIPTION OF THE INVENTION

Figure 1:
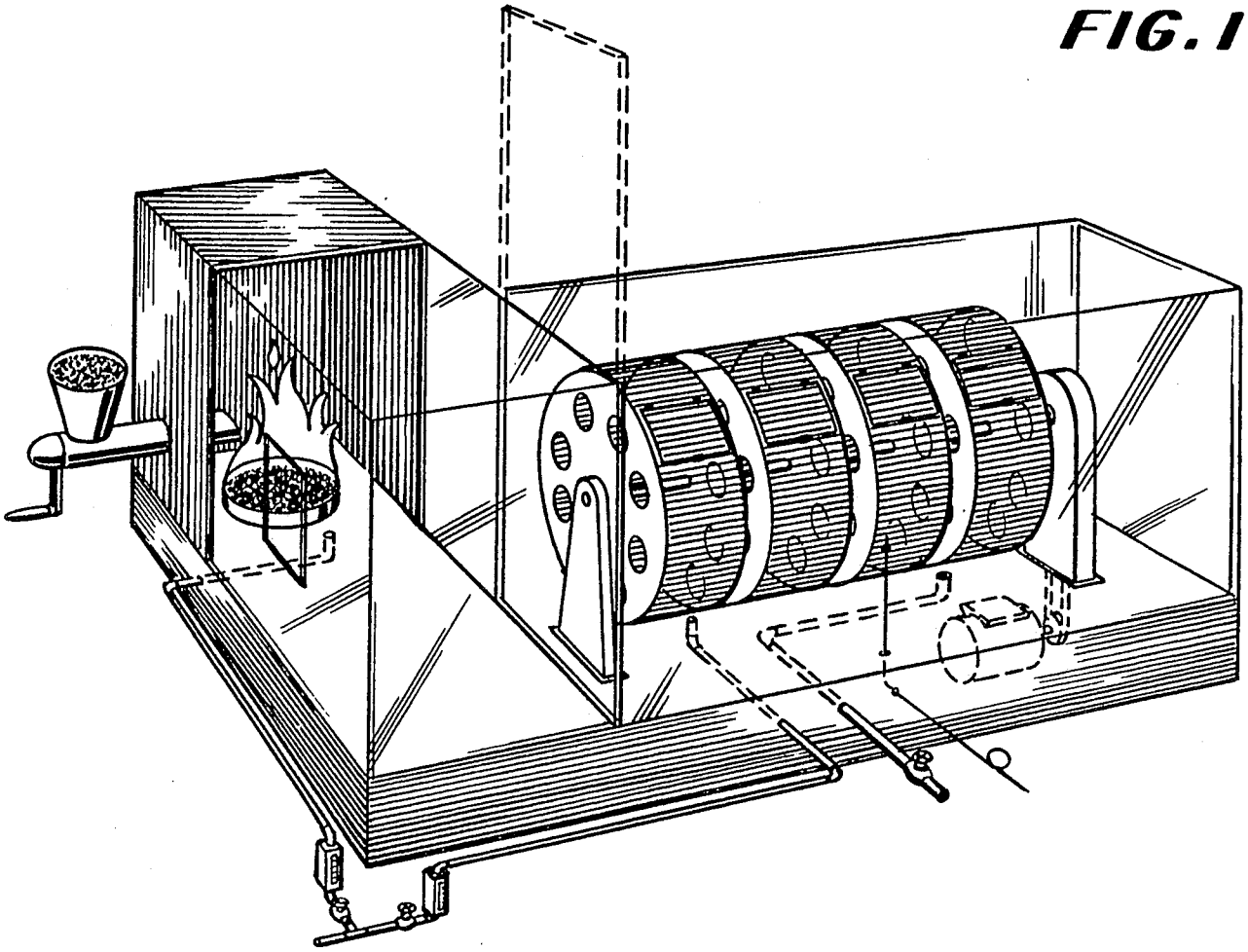
FIG. 1 is a diagram of the experimental apparatus used in the first series of experiments demonstrating both extinguishment of the fire and the continued consciousness of laboratory animals.

The problem when fighting or extinguishing fires in an enclosed are is that toxic products of combustion are usually released which may be injurious or lethal to animal life. The existing oxygen in the enclosed area at the start of the fire is both consumed by the fire and displaced by the generated gases, thus producing a lower oxygen content in the confined area which can result in unconsciousness and death for any animal life present in the confined area. Hot gases and flames produced by the fire also find their ways into vent ducts and subfloorings propagating the fire and spreading the toxic and combustible bases far beyond the original enclosed area. Most conventional methods for fire-fighting, as discussed above, attack only part of the problem, but not all of the problem. For an example, water must be applied directly to the fire however, it cannot follow fires into duct works and subflooring spaces. Water also helps to generate additional toxic gases and cannot deal with the gases which have been released; additionally, water can be damaging to equipment, especially, electronic and computer equipment. Conventional carbon dioxide fire-fighting systems, i.e., 100% $CO_2$, require roughly a 35–75% displacement of the oxygen in the area before extinguishing the fire, however, in those concentrations, the carbon dioxide is lethal to human life. Fluorocarbons (halons), once thought to be safe, are unsafe. Generally, they break down in fires and produce toxic concentrations of by-product gases in short periods of time. The production of toxic byproduct gases begins with the contact of the halons with the fire source. The period of time in which a toxic concentration is produced will depend on the fire intensity. Additionally, halons are very expensive and cannot be used except in special situations. The extinguishment of fires using the introduction of nitrogen under pressure is limited to uses in sealed spaces; the effective use of the method requires a positive pressure to be kept in the confined space.

As can be seen from the above and the background information, the solutions presented do not deal directly with the multiple problems of fires in many confined areas where human life may be present. They look at half the problem—the extinguishment of the fire. They do not, on the other hand, provide the means for extinguishing the fire while minimizing undue hazards to human life. In particular, they do not answer the problem of how to maintain both consciousness and the retention of mental acuity, thereby allowing for escape from the fire hazard.

The present invention is a method for controlling and extinguishing fires in a confined air-containing space while maintaining the confined space habitable for mammalian life, in particular, human life. The process of the present invention comprises introducing in the confined space an effective amount of carbon dioxide and another inert gas which is not toxic itself nor will decompose at combustion temperatures to produce toxic gases, e.g. nitrogen or helium, so as to lower the oxygen content of the confined space from its initial ambient concentrations to an amount which does not support combustion, however, does support life, e.g. 8% to 15% oxygen by volume and preferably 10% to 12% oxygen by volume, and increase the carbon dioxide content of the confined space from its initial ambient concentration to an amount which increases brain blood flow and brain oxygenation, e.g. 2% to 5% $CO_2$ by volume.

In addition to the carbon monoxide and other inert gas introduced into the confined space in the event of a fire, a polyatomic gas having a high heat capacity can be introduced into the confined space to aid in extinguishing the fire. The term "polyatomic gas having a high heat capacity" is used in the prior art, in particular, in U.S. Pat. No. 3,840,667, to describe a group of gases which in a generic sense comprise gases selected from the class referred to as perfluorocarbons, which gases are inert and stable, and which gases when introduced into a oxygen containing atmosphere help extinguish fires by changing the heat capacity of the oxygen containing atmosphere (in addition to lowering oxygen concentration) such that the atmosphere will not support combustion.

The effect of this change in the gas composition of the confined space is two fold. First, lowering the oxygen concentration functions to extinguish combustion, and second, the increase in carbon dioxide helps animals retain consciousness and mental acuity by increasing brain blood flow and brain oxygenation. The method of the present invention, therefore, allows for the extinguishment of a fire in a confined area without the destruction to equipment while allowing added time for any personnel present in the confined area to escape. This added time is beneficial because it allows the personnel present in the confined space the ability to retain consciousness and their mental acuity during their escape.

As a review, it is known that the reduction of oxygen partial pressure can extinguish flame and reduce production of heat and smoke. This can be seen in the following table detailing the oxygen contents necessary to support combustion of selected flammables at 1 atmosphere of pressure; the normal atmospheric oxygen content is approximately 21% $O_2$ by volume.

OXYGEN FLAMMABILITY INDEX FOR VARIOUS MATERIALS

| Material | Oxygen (Vol %) |
|---|---|
| Cellulose Acetate | 16.8 |
| Plexiglass ® | 17.3 |
| Polypropylene | 17.4 |
| Polystyrene | 17.8 |
| A8S | 18.8 |
| Phenolic-Paper Laminate | 21.7 |
| Nylon 6. 6 | 24.3 |
| Pentane | 15.6 |
| Acetone | 16.0 |
| Toluene | 16.6 |
| Nitrobenzene | 13.2 |
| Hydrogen | 5.0 |
| Carbon Monoxide | 7.0 |
| Cotton | 18.4 |
| Polyethylene | 17.5 |
| Wool | 26.5 |
| Urethane Foam | 25–28 |
| Polytetrafluoroethylene | 95.0 |
| Carbon Black | 35.0 |
| PVC | 37.0 |
| Polycarbonate (Lexan ®) | 24.9 |
| Silicone Rubber | 28–38 |
| Rayon | 18.9 |
| Rubber (Natural) Foam | 17.2 |
| Kitchen Candle, Wick in Paraffin | 16.0 |

Also, it is known that moderate reductions of respired oxygen pressure, hypoxia, can be tolerated for various periods of time ("times of useful consciousness in hypoxia"), the duration of consciousness and functional competence depending upon the degree of reduction of respiratory oxygen pressure.

Physiological investigations have shown that normal men made unconscious by breathing hypoxic (low $O_2$) mixtures can be restored to consciousness by adding $CO_2$ to the same hypoxic breathing mixture.

It is possible in human subjects to measure the specific rate of oxygen consumption and blood flow in the brain. Through such measurements it has been found that, in atmospheres low in oxygen pressure (high altitude, low concentrations of oxygen in respired gas at any atmospheric pressure), the brain blood flow increases to sustain brain $O_2$ supply. If the hypoxia is severe, brain metabolism fails and consciousness is lost in spite of the increased brain blood flow.

A second and well know physiologic influence of hypoxia is a respiratory stimulation, produced by effects of low $O_2$ partial pressure upon chemical receptors attached to the carotid arteries. This hypoxic respiratory stimulation results in increased pulmonary ventilation, with excessive elimination of carbon dioxide from the lugs, blood and tissues. The particular, undesirable influence of the lowered blood carbon dioxide is the constrictor effect of the lowered $CO_2$ partial pressure upon brain blood vessels. This constrictor effect counteracts the improvement in brain blood flow cited above as otherwise associated with reduced oxygen pressure in blood during exposures to hypoxic atmospheres.

It is known that normal men made hypoxic by administration of 8% $O_2$ in $N_2$ at one atmosphere became unconscious in exposures as short as ten minutes. The unconsciousness has been found to be associated with fall in brain oxygen partial pressure, decreased brain metabolism, a moderate increase in brain blood flow, a respiratory stimulation and a decrease in carbon dioxide partial pressure of arterial blood. Addition of carbon dioxide to the respired 8% $O_2$ in $N_2$ results in a further increase in brain blood flow, an increase in brain oxygenation, return of brain metabolism toward normal, and restoration of consciousness, while still exposed to the same degree of atmospheric hypoxia that produced the unconsciousness. Exposures to 4 and 6% $O_2$ in $N_2$ have been carried out for periods of about three minutes, with a maintenance of consciousness for this brief exposure if carbon dioxide is added to the inspired gas. The short exposure periods of these tests are due to the known hazardous effect of extended exposure to hypoxia. In these test without added $CO_2$, consciousness could not be maintained for any practical length of time.

Exposure of arts to subnormal levels of oxygen pressure has been carried out in many laboratories to investigate relations to: maze and other learning performance, work performance, spontaneous locomotor activity, influence of diet on hypoxic tolerance, effects of intermittent hypoxic exposure and protection by various drugs.

Methods with animals are grossly less precise than for human studies, due primarily to the obvious qualitative and quantitative advantages of direct communication, purposeful participation and responsiveness with man as the subject.

Measures used in animals for purposes of experimental psychology are generally limited to: degree of spontaneous physical activity, tolerance in forced exercise to exhaustion, gross coordination of forced locomotion, repetitive learned positive response to a food reward, or learned avoidance of a noxious stimulus (e.g. shock). Methods involving response to food reward require chronic food deprivation, training and continual reconditioning. Shock avoidance methods permit use of normal (unstarved) animals, with acceptably short training and minor shock stimulus.

It has been discovered that carbon dioxide and another inert gas, which will not decompose under fire conditions to produce toxic byproduct gases, can be introduced to a confined area to extinguish any flame present in the confined area. This extinguishment is accomplished by lowering the oxygen concentration of the atmosphere in the confined area. The benefit of elevating carbon dioxide concentration in conjunction with lowering the oxygen concentration is that the increased carbon dioxide concentration of the atmosphere of the confined space helps increase brain blood flow and brain oxygenation in humans present in the confined space. This increase in blood flow and oxygenation results in continued consciousness and, most likely, better mental acuity.

In order to determine the efficacy of the present invention in fire situations, several experiments were run using laboratory animals. The results of these experiments are offered in the following examples.

OVERVIEW OF THE EXAMPLES

The following examples are based upon observations made in man. The specific purpose of these subsequent animal experiments was to devise and use a system for a detailed comparison of different breathable low $O_2$ gas mixtures in numbers of small animals (a) to determine whether the phenomenon found in man can be observed in small animals, (b) to evaluate general boundaries of safety, (c) to obtain statistically reliable information concerning the range of useful breathing gas composition in hypoxia, without and with added $CO_2$, yet which will not support combustion of most combustibles.

In the examples, the primary measure evaluated was direct visual observation during a moderate rate and duration of continuous walking, on a motor-driven treadmill wheel. This permitted use of properly fed, normal animals, short training periods and a standard working condition. No reward or punishment stimuli were required or used in these examples.

In the examples, the laboratory rat was selected to take advantage of the extensive past use of the rat for investigations of aspects of gross performance under stress conditions. Use of small rodents allowed use of the desired numbers without excessive cost. For the initial development stage of the method the Sprague-Dawley Male Albino Rat was selected. In refinements of exercise tests the Long Evans Rat was used.

EXAMPLE I

Test Apparatus and Procedure

Apparatus

As shown in FIG. 1, rotary treadmills ("walking wheels") were constructed as horizontal cylinders 25 cm. in diameter, and 8 cm. wide. Internal circumference (walking surface) was 78.5 cm.

The walking wheels were mounted in parallel on a shaft, and driven by a small DC motor with motor controller. Speed of rotation was controlled at 11.3±0.2 RPM, equivalent to approximately 9 meters per minute.

The walking wheel assembly was contained in a gas-tight, clear plexiglas exposure compartment of approximately 240-liter capacity. Construction of the walking wheels utilized perforated plexiglas to permit free gas exchange with the gas compartment and 2 mm wire mesh on the walking surface to provide traction during activity. Each of the four wheel compartments was individually accessible to remove an animal if this became sensible. For access to wheels within the compartment, sealed "glove ports" were mounted in the anterior wall. This provided access to the animals without altering the contained atmosphere. Exhausted animals could be removed through a small air lock.

Air, nitrogen and carbon dioxide were provided to the compartment through separate lines. Hypoxic gas mixtures were produced using the exposure compartment as a mixing chamber. Motion of the walking wheels and a closed-circuit blower system accomplished rapid mixing of compartment gases. During initial rapid flush, a vent was opened in the compartment wall to allow wash-out of original gas content. This vent was closed when the desired initial gas exchange was complete. Flushing half-time was less than 30 seconds to change from air to 12, 10 or 8% $O_2$. Half-time to attain 5% $O_2$ was approximately 45 seconds. This time was shortened in development of the improved rotary treadmill.

Gas composition within the exposure compartment was monitored with a Beckman Infrared $CO_2$ Analyzer, and a Servomix Controls Paramagnetic Oxygen Analyzer, calibrated prior to each experiment.

Temperature in the exposure compartment was monitored with a thermistor probe. No significant (>1° C.) temperature change occurred during initial flushes. During the one hour continuous exposures without flow in the exposure compartment, temperature rose as much as 320 C.

Test Animals

Male Sprague Dawley rats of approximately 145 grams were used throughout Example I, with multiple exposures at appropriate intervals.

Selection and Training of Animals

Thirty-seven rats were tested during each of two one hour training trials in the walking wheel, breathing air. Twenty rats were selected on the basis of adaptability to the walking wheel procedure and uniform walking pattern in the one hour selection trials.

Rats were used for experimental trials every three to four days, with control trials in air daily to maintain familiarity with the exercise wheel.

Exposure Pattern and Duration

Animals adapted to the laboratory for seven to ten days were exposed four at a time in the individual walking wheels. Maximum exposure to the walking exercise was 60 minutes. Each trial began with a 15-minute walking period of exposure to air at one atmosphere, with the wheel turning. At the 11.3 RPM selected empirically as appropriate for continuous walking, equivalent linear walking speed was 9 m/min. Gas in the exposure compartment was abruptly changed and exposure to a specific gas mixture for an additional 45 minutes of continuous walking during wheel rotation was attempted. When an animal clearly became incapable of purposeful activity and could not keep walking in pace with the rotating wheel it was removed and allowed to recover in room air.

EXPOSURE GAS CONDITIONS

Control Gas was room air contained in the exposure compartment and walking wheel at the beginning of each trial.

Hypoxic Test Breathing Gas Mixtures consisted of:

12% $O_2$, 0% $CO_2$ in $N_2$
10% $O_2$, 0% $CO_2$ in $N_2$
8% $O_2$, 0% $CO_2$ in $N_2$
5% $O_2$, 0% $CO_2$ in $N_2$

Hypoxic Test Gas Mixtures with $CO_2$ consisted of:

10% $O_2$, 5% $CO_2$ in $N_2$
8% $O_2$, 5% $CO_2$ in $N_2$
5% $O_2$, 5% $CO_2$ in $N_2$

Accuracy of Gas Mixing, checked in each trial by calibrated analyzers, was within ±0.2% for oxygen and carbon dioxide.

Characterization of Hypoxic Responses

Technical Influence of Apparatus on Responses

Periods of normal walking which occurred during exposure to air and hypoxic mixtures were occasionally disrupted by the animal's ability to grasp the mesh walking surface, or to grasp the perforated side wall of the walking wheel. This action led to the animal being carried backward by the rotating wheel until it released, fell and began walking again This defect in design was corrected in the improved rotary treadmill used in Example II.

Modification of Walking Behavior of Test Animals

Several deviations from walking behavior on the rotary treadmill occurred in some rats, unrelated to grasping at mesh or wheel perforations. Nontrained behavior of animals is not ordinarily described in existing reports and does not lend itself to quantitation or classification. The following descriptions serve the present tests.

Nonwalking actions included:

(1) Leaping: This occurred in place of regular walking, repeatedly or occasionally, and consisted of the animal riding backward with the wheel as it turned, leaping across the bottom arc of the wheel as it turned, then riding the wheel back again. This appeared to be an adaptive behavior for those rats that discovered it. Thirteen of sixteen did overall, and it was more frequent at 10% and 8% oxygen (10 rats), than at 12% (4 rats), or among controls in air (none). It is here treated as a competent, coordinated activity, as contrasted with uncoordinated tumbling.

(2) Tumbling: When walking was handicapped or impossible, the wheel rotation tended to cause the animals to ride back with the wheel, and tumble forward. When it appeared early in severe hypoxia, or late in a less severe trail, it was considered to be a sign of uncoordination and/or impending exhaustion in a rat which had walked and/or "leaped" up to that point. In advanced form animals passively slid and tumbled without attempting to grasp the wheel,. In a few instances Falling of coordinated rats occurred as a result of grasping the rotating wheel, and releasing as the rat became inverted. This was not in itself considered uncoordination.

(3) Sliding: sometimes when an animal could no longer walk or leap in synchrony with wheel rotation, it would lie on its belly, pull up its hind legs and slide along the moving surface, using its front legs to stay oriented. This was almost always followed by helpless exhaustion.

Relation of Behavior to Stages of Decreased Performance

The above-cited behaviors did not always occur in a uniform or sequential pattern as hypoxic effects developed. They cannot be considered to represent increasing degrees of hypoxic deterioration. However, keeping the stereotypes in mind, recognizable stages of hypoxic deterioration can be used, as follows:

Stages of Adaptation and Effect

I. No evident abnormality. Animal is using short natural steps to keep up with the wheel speed. Spends most of time at bottom of wheel, but may walk up face of wheel a short distance, or ride back a short distance before walking to bottom again.

II. Slightly but prominently affected. Does not walk well enough to easily keep up with wheel rotation. May adapt by resorting to leaping, or alternate periods of walking and leaping.

III. Definite locomotor disability. Rides back and tumbles in wheel frequently, but on landing orients to direction of wheel, and continues to make attempts to walk or leap.

IV. Unable to walk or leap with wheel, but still largely able to orient with wheel's direction. May resort to sliding on belly along bottom of wheel to avoid tumbling.

V. Loses ability to orient to wheel, but still able to hold head up and grasp at wheel's surface. May constantly tumble, or may slide on back or side, grasping at surface occasionally.

VI. Completely helpless, unable to use legs for support. Unconscious, or close to it.

Results/Summary

Summary of Specific Exposures to Hypoxia Without Carbon Dioxide

Figure 2:
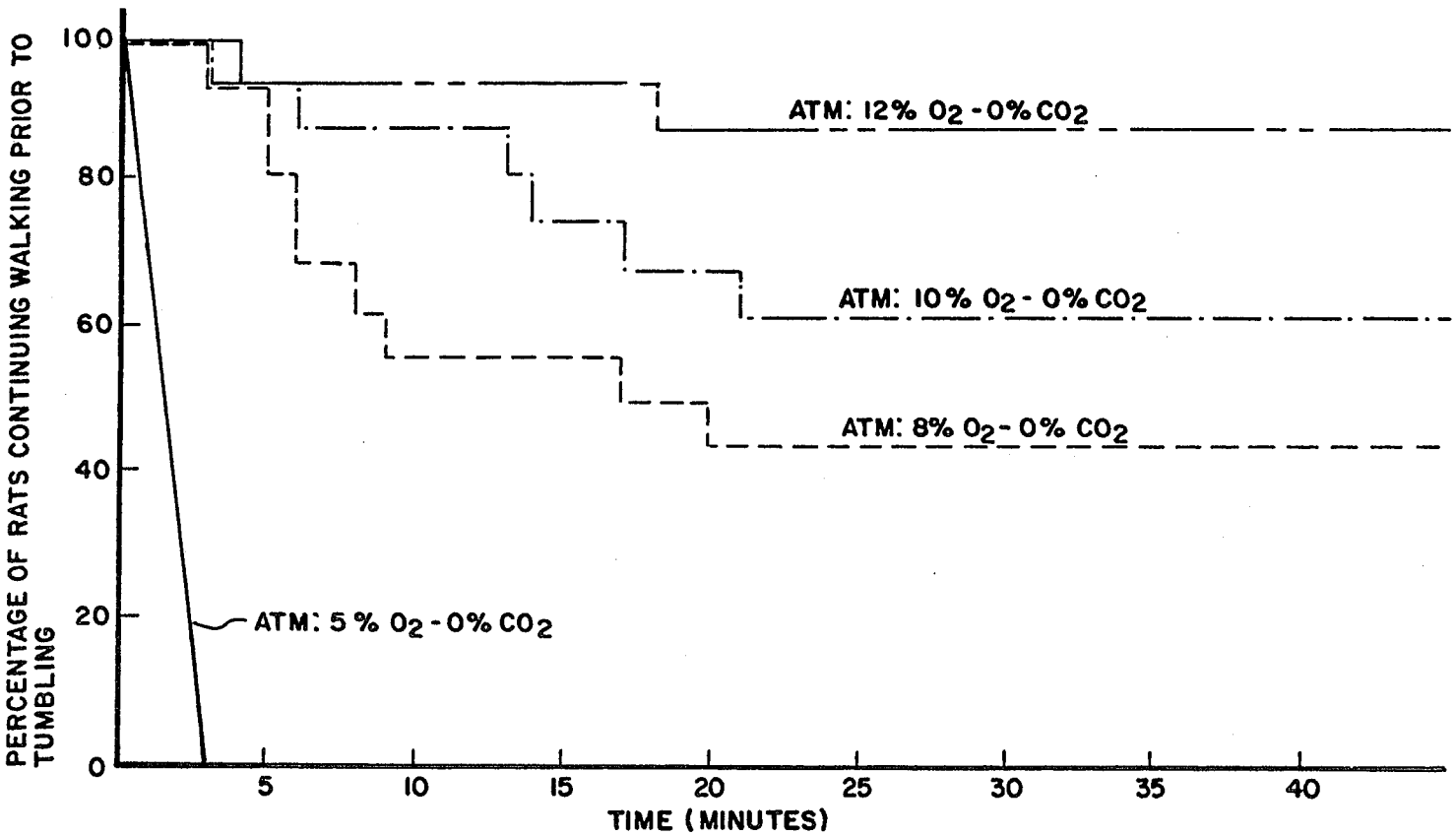
FIG. 2 is a plot illustrating the percentage of laboratory rats continuing walking prior to tumbling versus time for atmospheres containing various concentrations of oxygen and no carbon dioxide.

A graphical summary of the results of the specific test of hypoxia atmospheres without carbon dioxide are shown in FIG. 2. A description of these results are as follow:

Air Breathing Controls: Normal walking occurred (a) throughout each 15-minute air breathing episode preceding hypoxia, and (b) throughout the entire 60-minute (15+45 min) periods for the air breathing control group. No animal was exhausted or otherwise evidently affected by this exposure to forced walking activity in air.

12% $O_2$, 0% $CO_2$: Fourteen of the sixteen test animals completed the 45 minute walking period without difficulty. Two stopped walking intermittently, resulting in tumbling. This appeared to be related to grasping at wheel more than to any prominent decrease in walking coordination. No animal was removed from the exposure. Effects were significantly greater with 10, 8 and 5% $O_2$.

10% $O_2$, 0% $CO_2$: Ten of sixteen test animals completed the 45-minute hypoxic exposure with coordinated walking and leaping. Six exhibited interruption of walking, with resultant tumbling. Three stopped purposeful effort and were removed (at 15, 24 and 29 minutes of hypoxia).

8% $O_2$, 0% $CO_2$: Only one of sixteen animals completed the 45-minute walking period. Fifteen were removed due to uncoordinated tumbling, between 7 and 26 minutes of hypoxic exposure.

5% $O_2$, 0% $CO_2$: All 16 test animals were tumbling uncoordinated and removed by three minutes of hypoxic exposure.

Summary of Effects of Hypoxia with Carbon Dioxide

Effects of 5% $CO_2$ addition were not uniform among the different degrees of hypoxia tested. This was expected since (a) the range of hypoxia, from severe to moderate, was extreme, and (b) the respiratory stimulant effects of carbon dioxide could induce distracting sensations in the rat even in the least severe hypoxia.

Figure 4:
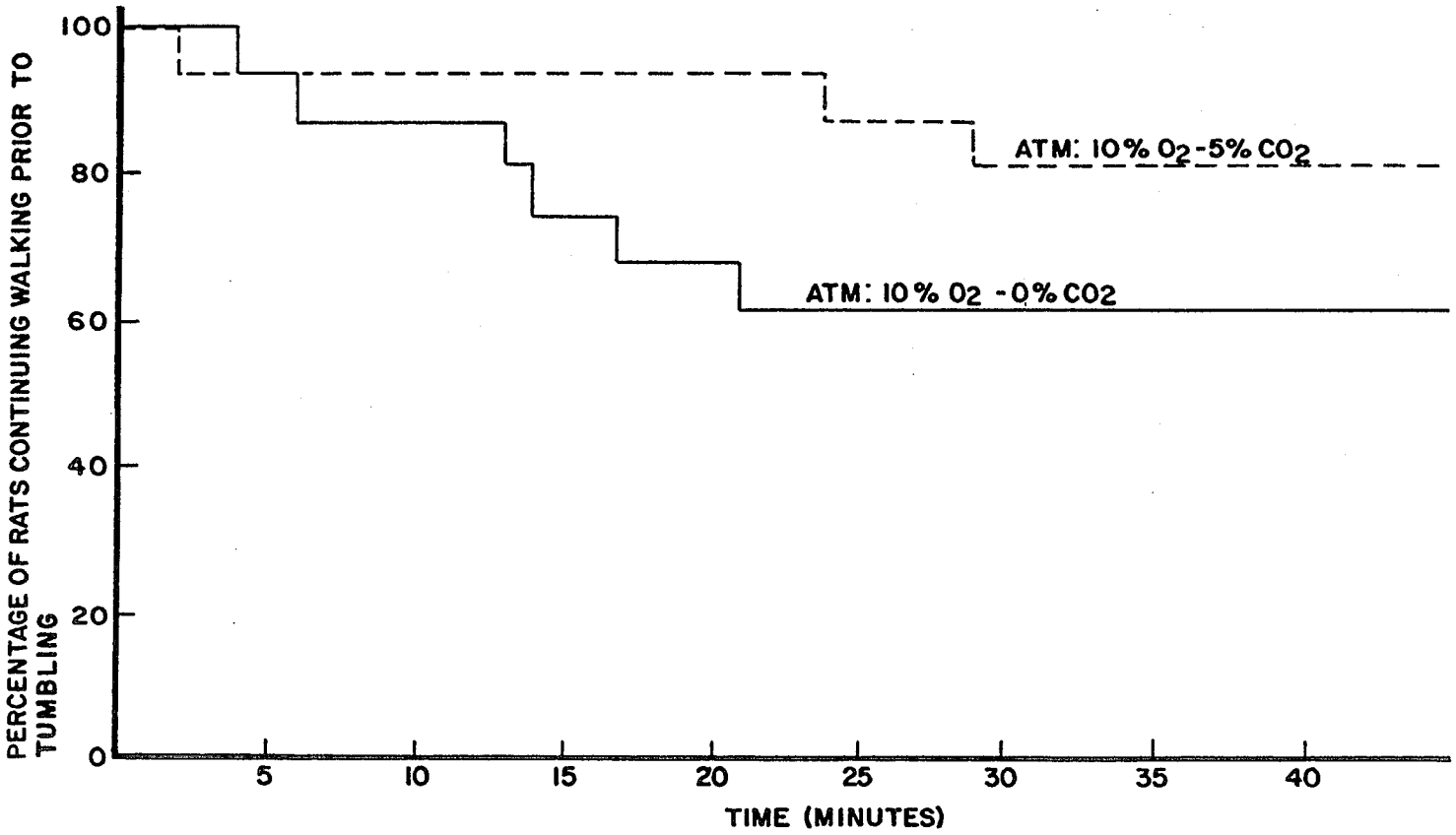
FIG. 4 is a plot illustrating the percentages of rats continuing walking prior to tumbling versus time for atmospheres containing 8% oxygen and either 0% or 5% carbon dioxide.

10% $O_2$, 5% $CO_2$. Uncoordinated walking (tumbling) developed less rapidly and in fewer animals with added carbon dioxide than with 10% $O_2$ alone. Nevertheless, after 23 minutes of walking exposure, three of sixteen rats exposed to hypoxia with carbon dioxide were sufficiently uncoordinated to be removed. The same number were ultimately removed for 10% $O_2$ without $CO_2$. A graphical summary of the results of the tests using this specific hypoxia atmosphere is shown in FIG. 4.

Figure 3:
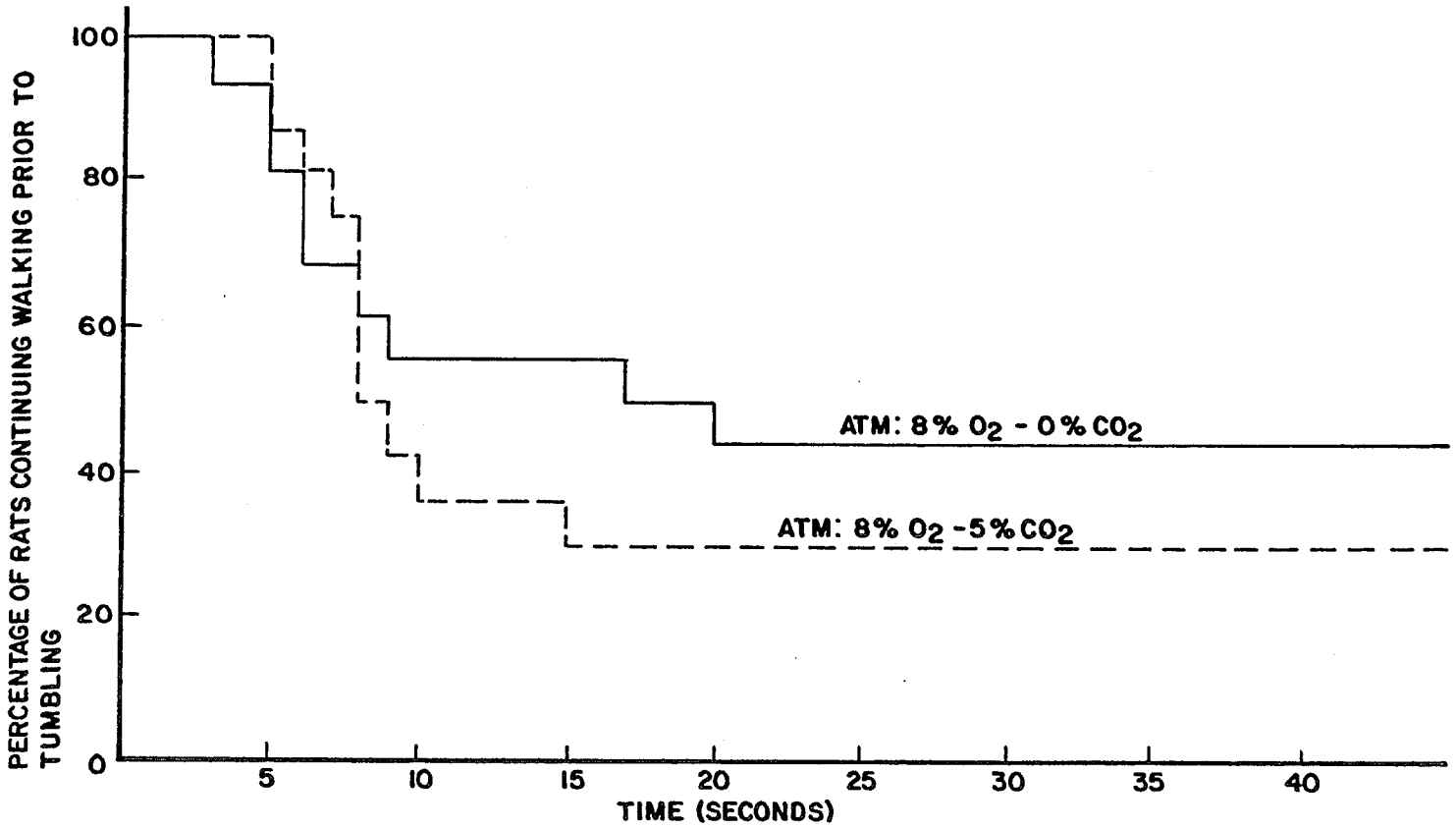
FIG. 3 is a plot illustrating the percentage of rats continuing walking prior to uncoordinated tumbling versus time for atmospheres containing 10% oxygen and either 0% or 5% carbon dioxide.

8% $O_2$, 5% $CO_2$. Uncoordination developed as early as 2 to 8 minutes in approximately half the sixteen test animals, as it did with 8% $O_2$ without $CO_2$. As exposure duration increased, tumbling in the remaining rats appeared to develop more rapidly with than without added carbon dioxide, but this difference was not significant. One rat died abruptly while walking in its last trial, in 8% $O_2$ with $CO_2$, at the eight-minute mark of hypoxia. This failure is considered too rapid to have been solely due to the exposure conditions. However, no explanation or evidence of preexisting defect was available or provided by gross pathological examination. A graphical summary of the results of the tests using this specific hypoxia atmosphere is shown in FIG. 3.

Figure 5:
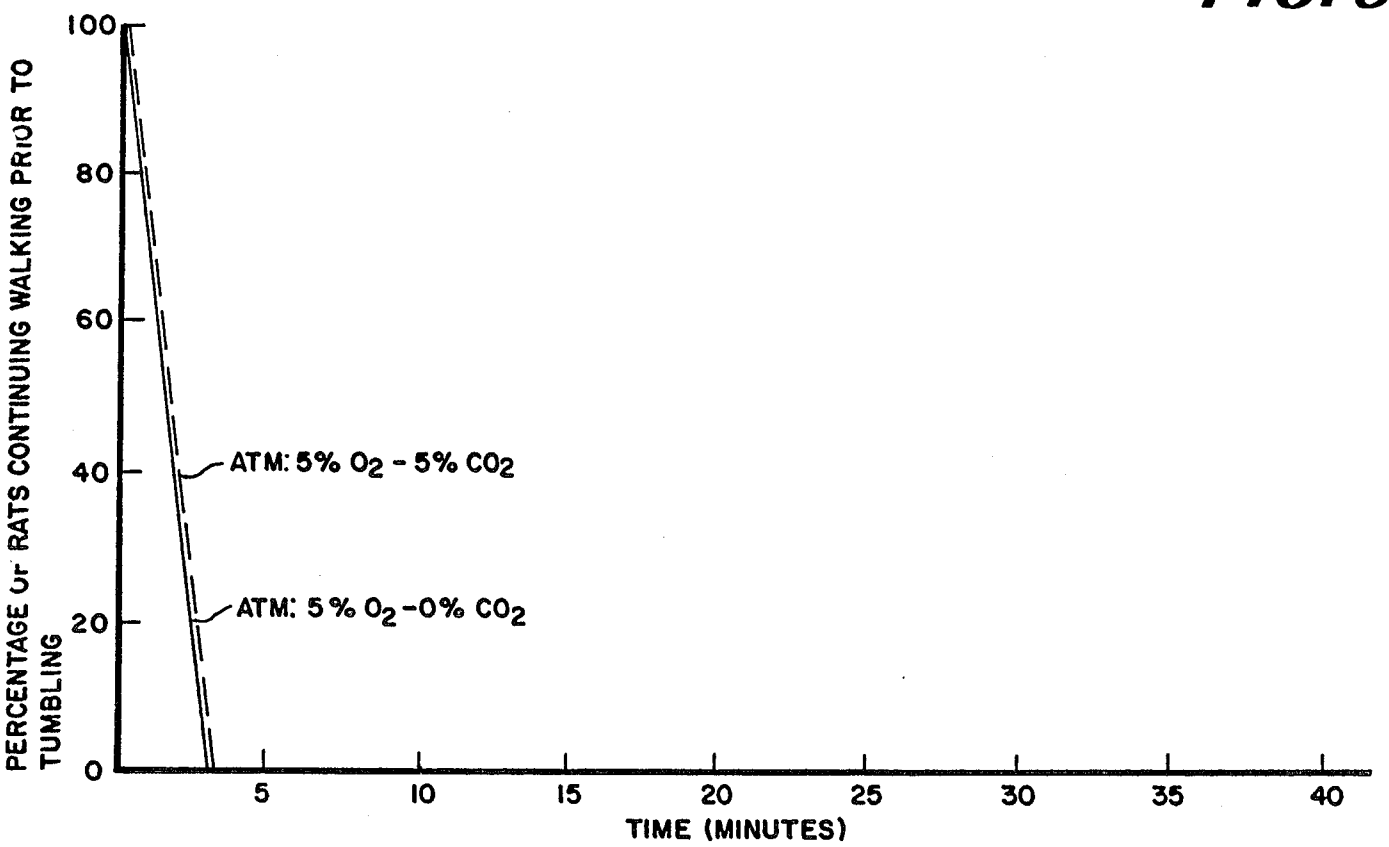
FIG. 5 is a plot illustrating the percentages of rats continuing walking prior to tumbling versus time for atmospheres containing 5% oxygen and either 0% or 5% carbon dioxide.

5% $O_2$, 5% $CO_2$: The rate of inactivation of rats with added $CO_2$ was not significantly different from the fulminating inactivation (less than 3 minutes) by this extreme degree of hypoxia alone. Rats were not kept in the severely hypoxic atmosphere after becoming incapacitated. A graphical summary of the results of the tests using this specific hypoxia atmosphere is shown in FIG. 5.

Interpretations

Flame of most substances is extinguished at oxygen pressure capable of sustaining consciousness and coordinated physical activity for useful periods. Extreme hypoxia (5% $O_2$) provides too little "Time of Useful Consciousness" to permit escapes and is unlikely to be adequately overcome by addition of carbon dioxide, see FIG. 5.

The tests show that in less severe degrees of hypoxia, the addition of $CO_2$should improve the retention of fine performance as well as physical capability. The effect of very high levels of carbon dioxide is expected to be detrimental, even in the absence of hypoxia. This was not investigated by the above tests.

Improvement in test procedure for small animals appears to be practical, by refinement of test apparatus to remove artifacts (wheel riding), to speed rate of gas change, and to determine effects on different functions (walking, avoidance) in moderate degrees of hypoxia.

The existence of data in man showing beneficial effect of $CO_2$ in hypoxic exposures justifies refinement of animal measurements for use in planning eventual applied studies in man.

EXAMPLE II

Test Apparatus and Procedure

Apparatus: Treadmill—Exposure Chamber

To minimize artifacts produced by animals grasping wheel axle, perforations or wire mesh walking surface, all of these previous defects were eliminated in an improved rotary treadmill development.

Figure 6:
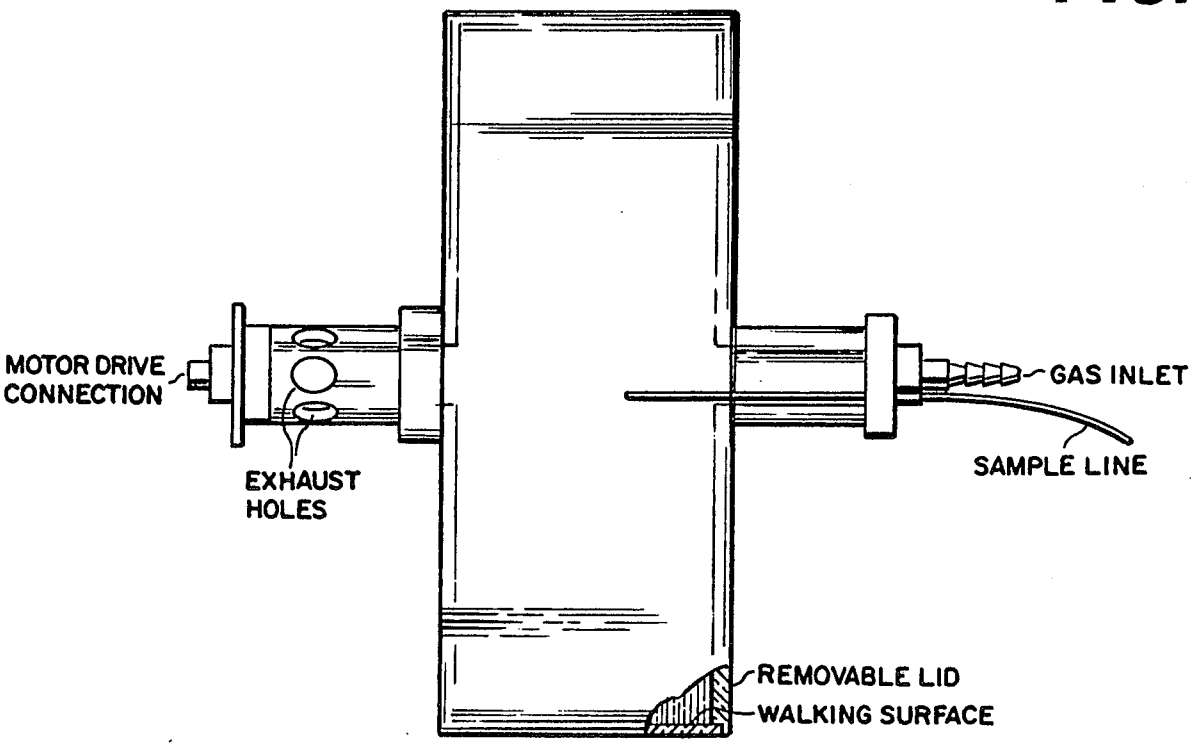
FIG. 6 is a diagram of the walking wheel exposure chamber used in Example 2.

The Example II Rotary Treadmill was constructed of clear plexiglass without an internal axle, with smooth internal sides, and with simple roughened walking surface in place of mesh, as shown in FIG. 6. The inner diameter of the treadmill was 24.8 cm, with a width of 9.5 cm, giving a volume of approximately 4600 cc. One side of the wheel could be removed for insertion and removal of animals, and for cleaning. Motor drive was reversible to allow reversal of rotation at will, to check on coordination of test animal. The wheel at this stage was single, to allow full attention to the single animal, pending development of improvements in determining hypoxic effects.

Gas Administration

Figure 7:
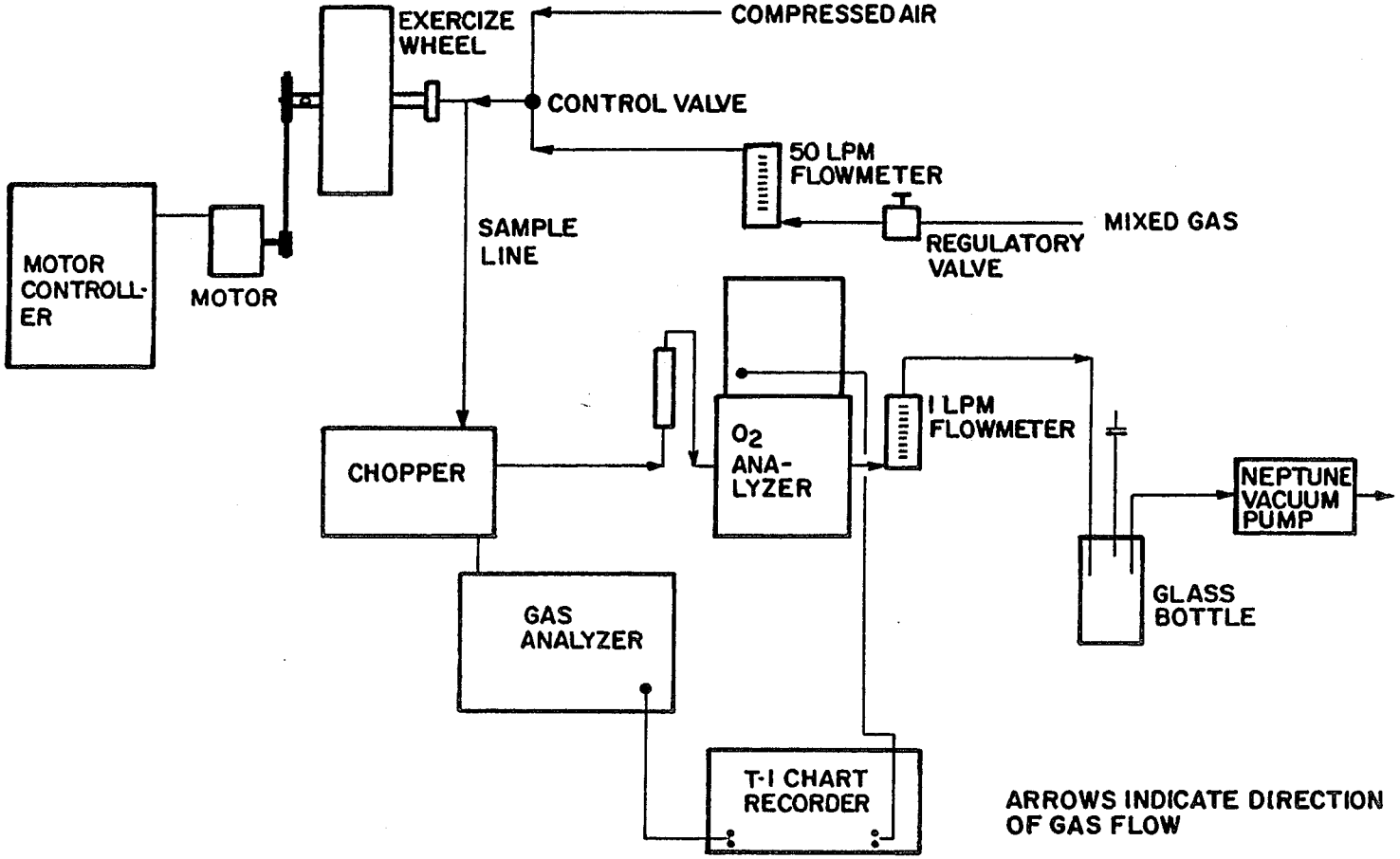
FIG. 7 is a schematic diagram of the experimental layout for the Example 2.

Gas administration and exhaust were provided through the hollow hubs of the treadmill wheel, allowing rapid change in gas composition and eliminating need for a large exposure compartment to contain the treadmill. A manual two-way valve controlled whether air or mixed gas was injected into the treadmill, see FIG. 7. Pressurized compressed gases were supplied from cylinders with regulator and flowmeter placed in each gas line to provide for control of gas flow.

Gas composition within the wheel was continuously monitored for $O_2$ and $CO_2$ by drawing gas from the interior of the wheel through a sampling tubing mounted in the hollow hub, and then through the $CO_2$ and $O_2$ analyzers as used in Example I, see FIG. 6.

Gas Change Rate

The half-times for change of gas composition in the wheel was determined at different rates of nitrogen flow into an air-filled wheel. Flow rates and associated half-times for gas washout in the 4500 cc wheel compartment were as follows:

| Flow (1 pm) | Half-time (sec.) |
|---|---|
| 10 | 28 |
| 20 | 17 |
| 30 | 13 |
| 40 | 11 |
| 50 | 10 |

A flushing flow rate of 30 liters per minute was chosen for animal exposure trials, due to its short half-time and relative economy of gas. Flow was reduced to 10 liters per minute during the subsequent exposure periods.

Test Animals

Male "Long Evans Rats" were used in this example. These are considered more suitable than Sprague Dawley for exercise trials. Beginning rat weight was 180 to 200 grams.

In an adaptation to the trials, each rat had a training period of 30 minutes, and one of 40 minutes in the rotary treadmill breathing air. During training and trial periods of air breathing, each rat was observed continuously so its normal walking behavior in air could be compared with its behavior during hypoxic exposures.

Exposure Gas Mixtures

A series of eight gas mixtures were used in the Example II with the improved Rotary Treadmill, these gas mixtures are listed in the following Table.

Mixtures of $O_2$ in $N_2$, With and Without Added Carbon Dioxide.

| Gas No. | Code Designation | % $O_2$ | % $CO_2$ |
|---|---|---|---|
| 1 | 6–0 | 5.9 | 0 |
| 2 | 6–5 | 6.4 | 5.2 |
| 3 | 6–10 | 6.0 | 10.2 |
| 4 | 8–0 | 8.0 | 0 |
| 5 | 8–5 | 8.1 | 5.5 |
| 6 | 8–10 | 8.3 | 10.4 |
| 7 | 10–0 | 9.7 | 0 |
| 8 | 12–0 | 11.9 | 0 |

The oxygen partial pressures were selected to cross-relate with the exposures of Example I. Six percent oxygen was used as an exposure higher than the 5% oxygen which induced fulminating collapse in Example I.

The carbon dioxide concentrations were selected to provide zero % $CO_2$, a tolerable level (5% $CO_2$), and a distinctly excessive level (10%) in search for interactions with hypoxia.

Exposure Sequence and Durations

For evaluation of the improved test system, six rats were used individually in each gas exposure. Five of these animals were used in every test condition. One animal died in an early exposure to 6% $O_2$ with 10% $CO_2$ and was relaced.

Animals were placed in the treadmill for a 5-minute period of walking in air prior to each hypoxic exposure. Transition to hypoxic mixtures was abrupt, followed by stable hypoxia/or hypoxia with added carbon dioxide. Continuous direct observation was carried out during a 40-minute exposure to the test gas, or at least until the animal was clearly helpless. The direction of wheel rotation was occasionally switched to determine the responsiveness of the rat. This procedure was used when the animal was not walking (e.g., sliding or tumbling).

Character of Hypoxic Responses

Technical Influence of Apparatus on Responses

Responses to hypoxia were not distinguishably different in the initial (example I) and improved rotary treadmill systems, except for the intended near elimination of wheel riding (decreased grasping opportunity).

Relation of Behavior to Stages of Decreased Performance

Refinement of the description of animal responses to hypoxia and carbon dioxide, based upon observations in Examples I and II, led to defining the following five stages of overall competence:

Stage 1 (Level 1): Normal walking behavior. The animal can easily maintain its position in the wheel without any sliding.

Stage 2 (Level 2): some abnormal but very functional behavior. The rat may have some trouble keeping up with the wheel rotation resulting in the rat leaping from the back of the wheel to the front. Other abnormal behaviors such as turning around, holding onto the axle opening may be demonstrated. The rat may alternate normal walking with some abnormal behavior.

Stage 3 (Level 3): Increasingly abnormal and less functional behavior. The rear legs are typically sliding; the rat may leap weakly and may show brief, complete sliding. The rat appears to be alert and responds quickly to a change in the wheel rotational direction. This stage is mainly distinguished from Stage IV by fairly continuous activity but not typical walking. This Stage was used as the distinct indication of subnormal performance.

Stage 4 (Level 4): Primarily just sliding. The rat may show occasional purposeful movements such as front leg walking. The animal is still alert but slowly responsive to changes in wheel direction. The rat may tumble or roll helplessly but will still show some voluntary movements.

Stage 5 (Level 5): Completely unresponsive. The rat may be unconscious or nearly so. The rat shows no voluntary movement.

The exposure duration at which the rat reached these stages was recorded for each rat.

Results/Summary

Overall

Figure 8:
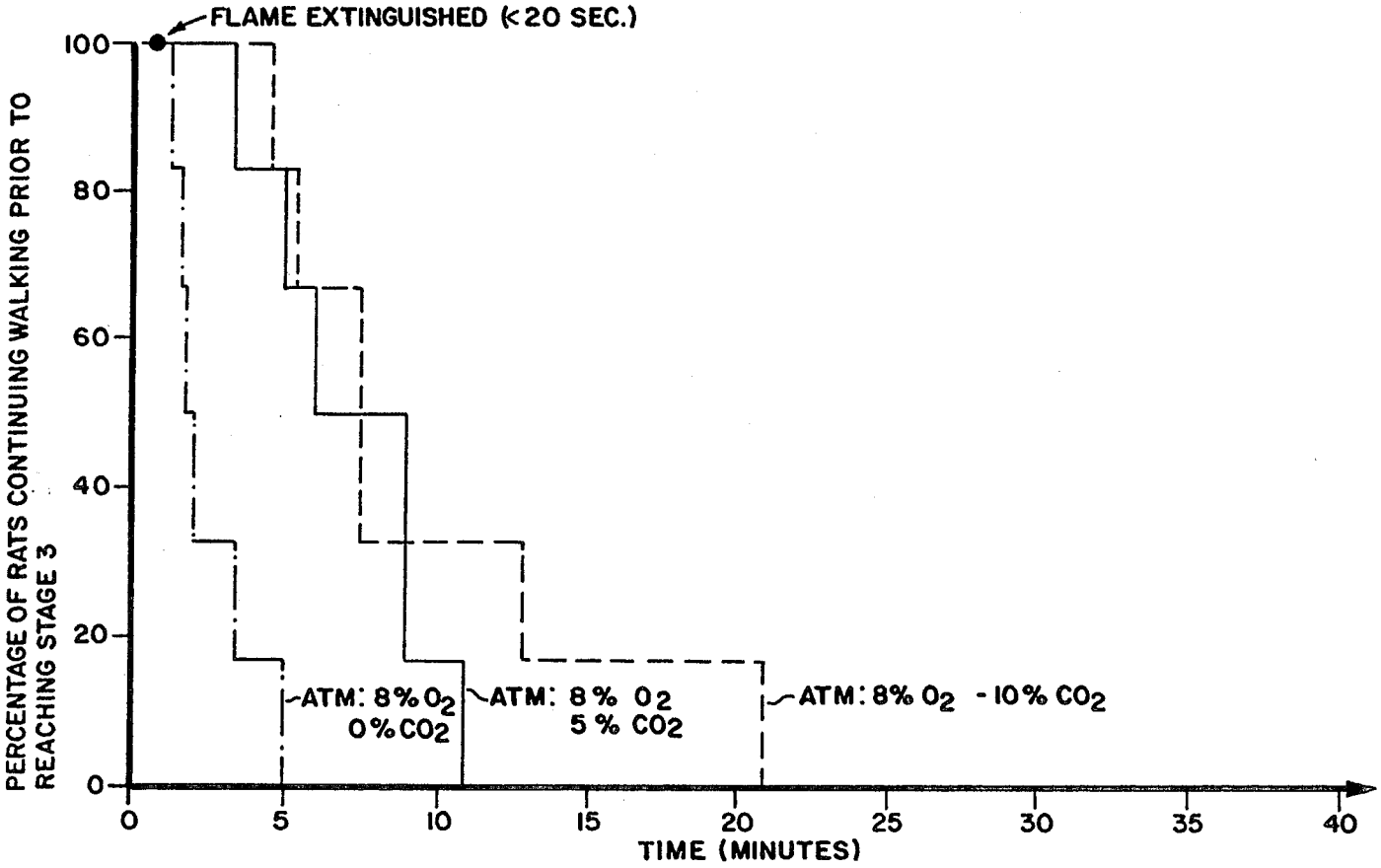
FIG. 8 is a plot illustrating the percentage of rats continuing walking prior to reaching atypical walking versus time for atmospheres containing 8% oxygen and carbon dioxide contents of 0%, 5% or 10% by volume.
Figure 9:
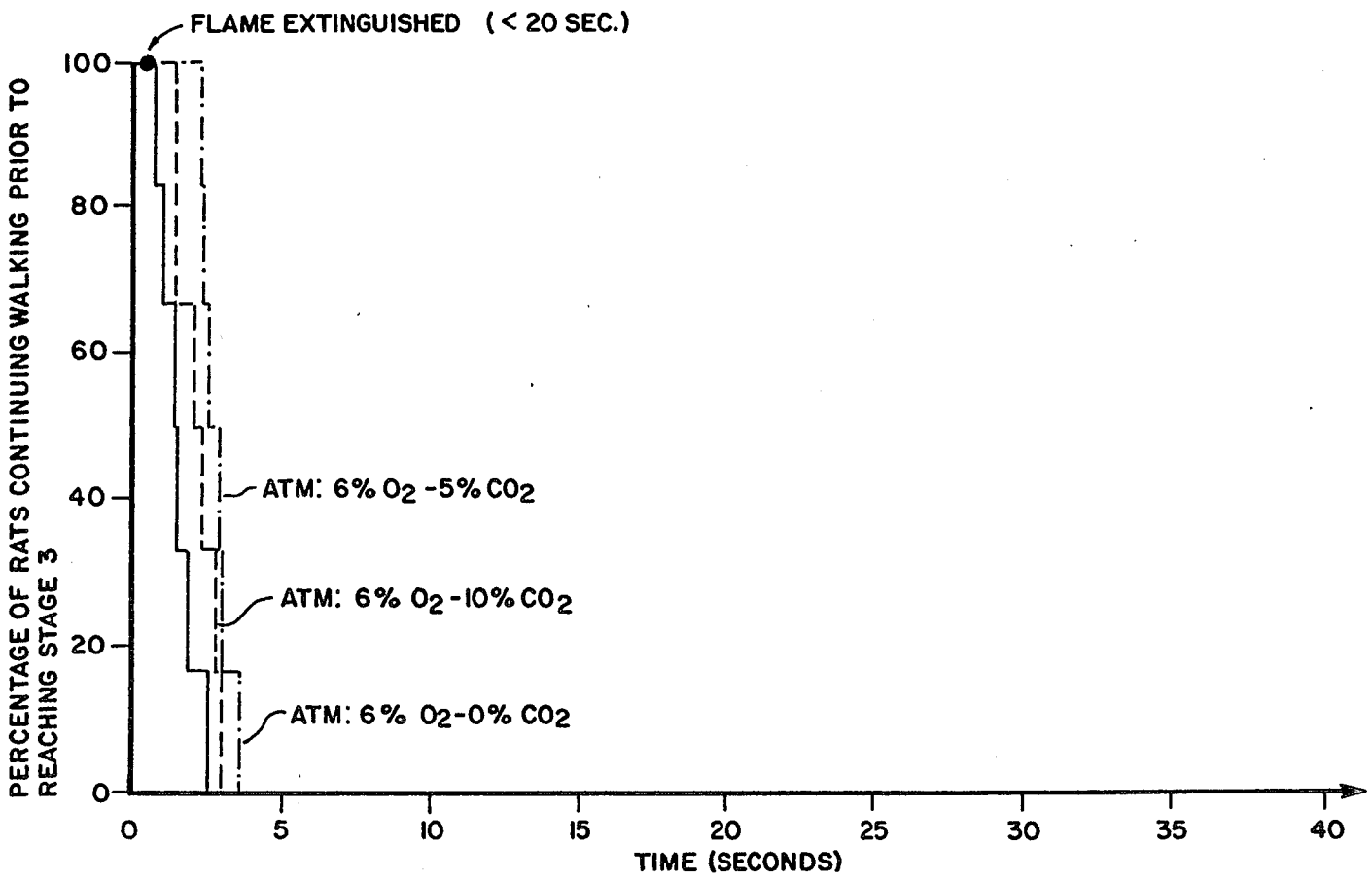
FIG. 9 is a plot illustrating the percentage of rats continuing walking prior to reaching atypical walking versus time for atmospheres containing 6% oxygen and carbon dioxide contents of 0%, 5% or 10% by volume.
Figure 10:
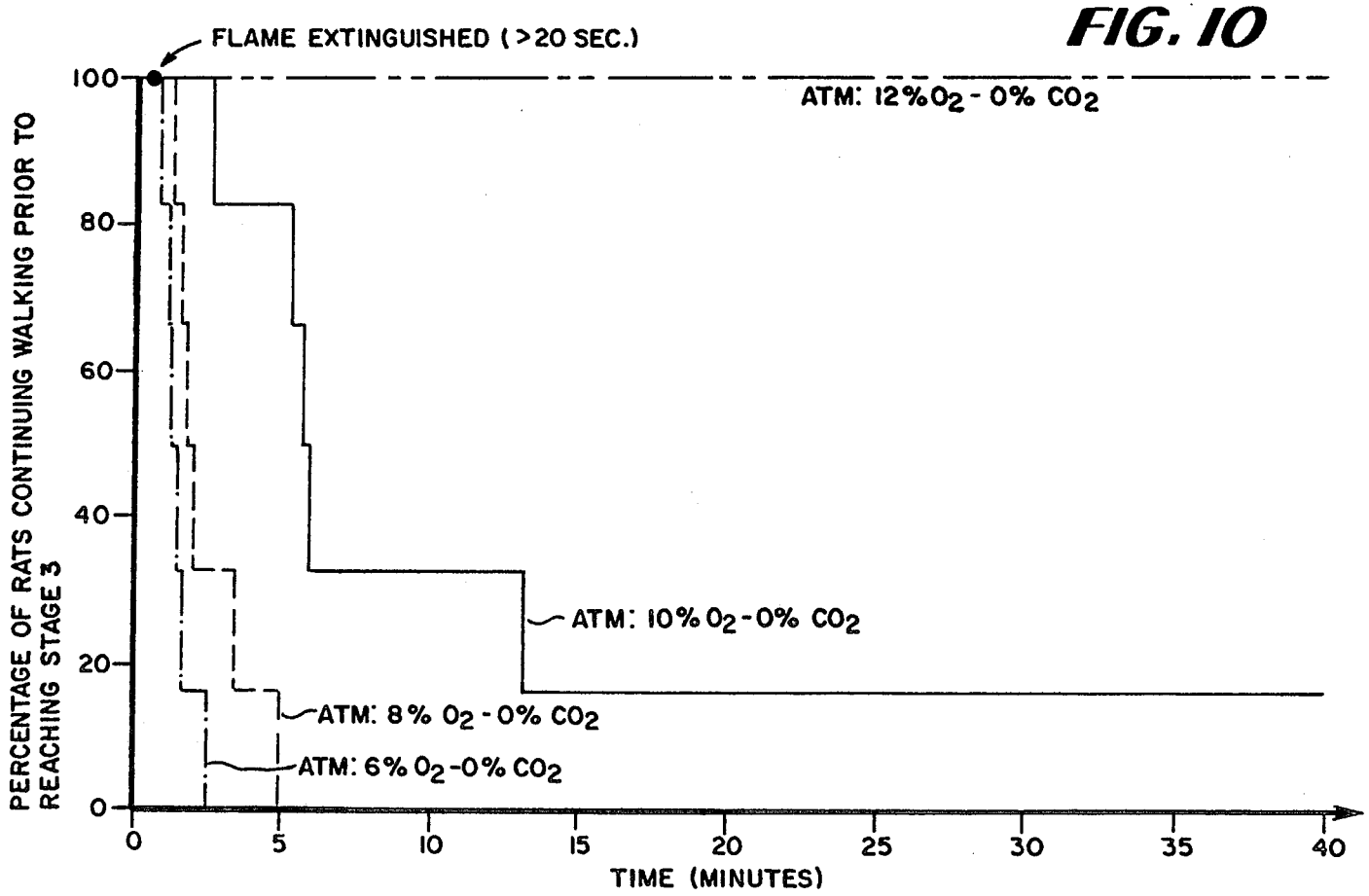
FIG. 10 is a plot illustrating the percentage of rats continuing walking prior to reaching atypical walking versus time for atmospheres containing 6%, 8%, 10% or 12 oxygen by volume and no carbon dioxide.

Graphical summaries of the results of the specific tests of hypoxia atmospheres with and without carbon dioxide are shown in FIGS. 8 through 10. A description of these results are as follow:

Exposure to Air

During the training exposures the rats breathed normal air (21% $O_2$, 0% $CO_2$). All rats walked normally throughout the 30-minute and 40-minute training periods. If leaping occurred it was always strong and coordinated.

Exposure to Hypoxia Without Carbon Dioxide

12% $O_2$, 0% $CO_2$: All of the rats exhibited normal walking behavior for the first seven minutes. Four out of six reached Level 2 (slight but evident effect while continuing walking) within 15 minutes, the other two in 26 and 40 minutes. All six completed the 40-minute walking exposure at Level 2, without developing prominent subnormal performance.

10% $O_2$, 0% $CO_2$: All six rats reached Level 2 (some abnormal, but still functional behavior) within 3 minutes of beginning exposure. Within 13 minutes five out of the six reached Level 3 (distinct incoordination) and three of those reached Level 4 (periods of essentially full incapacitation) by 24 minutes. One rat remained at Level 2 and two at Level 3 for the duration of the exposure.

8% $O_2$, 0% $CO_2$: After 1.5 minutes all six rats had reached Level 2 and by 5 minutes all were distinctly uncoordinated (in Level 3). It took an additional 3 to 14 minutes for the rats to reach essentially full incoordination (Level 4). All the rats completed the 40-minute exposure, but throughout it remained in Level 4.

6% $O_2$, 0% $CO_2$: Level 2 (evident but slight effect) was reached by all six rats within 1 minute, 10 seconds. By 2.5 minutes all were in Level 3. After 16 minutes five of the six rats were in Level 4 with the last rat reaching this Level after 26 minutes. All rats remained in this Level for the rest of the 40-minute exposure. On return to air breathing, rats appeared alert within 1 to 3 minutes, but did not move about actively for a longer period (more than 5 to 10 minutes).

Exposure to Hypoxia with Added Carbon Dioxide

8% $O_2$, 5% $CO_2$: All the rats were in Level 2 within 4 minutes. Between 3.5 and 11 minutes they were all in Level 3 and two rats continued in this Level for the remainder of the 40-minute exposure. The other 4 rats entered Level 4 after 11 to 19.5 minutes and remained in this stage for the duration of the 40-minute exposure.

8% $O_2$, 10% $CO_2$: Between 1.5 and 4.5 min. all the rats were in Level 2 (evident but slight effect). Four of six rats were in Level 3 after 13 and 21 minutes. Three of the rats remained in Level 3 for the duration while the other three entered Level 4 at 16, 28 and 36 minutes and remained in Level 4. One rat was only exposed for 24 minutes (removed in Level 3) because it was continuously pushing its head into the exhaust axle, blocking gas flow and may probably have been occasionally able to breath room air.

6% $O_2$, 5% $CO_2$: Within 2 minutes all six rats had reached Level 2 (evident but slight affect). After 3.6 minutes all had reached Level 3 (distinct in coordination). The rats all reached Level 4 between 4 to 23 minutes. All six rats finished the 40-minute exposure in Level 4. Recovery of ambulation appeared prompt (within 1 to 2 minutes on being replaced in cage, with the rats moving about actively immediately on beginning walking.

6% $O_2$, 10% $CO_2$: all six rats were in Level 2 after 1 minutes. After 3 minutes all six rats had reached the distinct incoordination of Level 3. By 9 minutes all the rats were in Level 4. Between 17 and 35 minutes of exposure all the rats had died. The death was preceded by 1 to 13 minutes of labored breathing. Gross autopsies of 4 of the rats revealed no predisposing pathological cause of death. Death was considered due to the predisposing stresses of severe hypoxia combined with severe hypercapnia.

Figure 11:
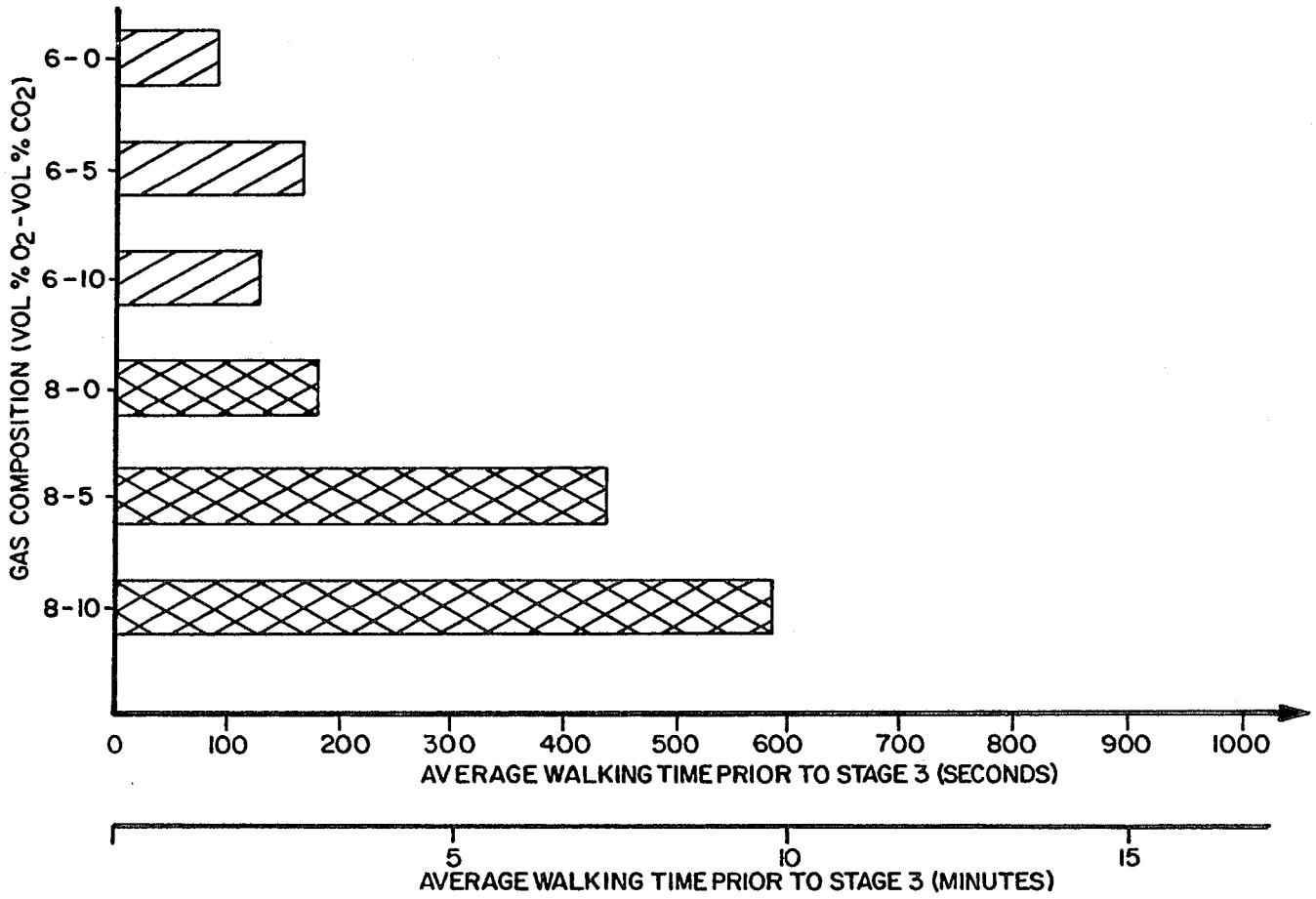
FIG. 11 is a bar plot of gas mixtures having varying percentages of oxygen and carbon dioxide versus average walking time of rats prior to reaching atypical walking.

Means of exposure duration leading to Level 3 are shown in FIG. 11 for each exposure to 6 and 8% $O_2$.

Interpretations

The use of the plexiglass rotary treadmill, without a surface to which the test animals could cling, simplified detection of initial stages of hypoxic effect. The "walking wheel" should be generally useful as presently designed, and should permit obtaining significant results with fewer animals than with previous treadmill.

The present scale of effects upon coordinated physical activity provides useful quantifiable indices of hypoxic effect in small numbers of animals. Consistent reduction in performance capability was demonstrable with progressive lowering of $O_2$ from 12 to 10 to 8 to 6%.

Flame of most substances is extinguished at oxygen partial pressures capable of sustaining consciousness and coordinated physical activity for useful periods, particularly with the presence of carbon dioxide.

Looking therefore at the composite results from Examples I and II, they indicate that:

Petroleum flame is extinguished at oygen concentrations that sustain rats in normal activity. Flame extinguished in less than 20 seconds in oxygen concentrations, with and without carbon dioxide, of less than 12 vol %.

The use of 5 to 6% $O_2$, with or without added $CO_2$, provides very short time (less than 5 Minutes) for corrective action and produced an unacceptably rapid loss of functional competence.

Use of approximately 8% $O_2$, with or without added $CO_2$, approaches the lower level of hypoxic exposure to be considered appropriate for situations requiring immediate escape or corrective action.

The range between 8 and 12% $O_2$ appears to represent the range of most likely usefulness, with or without $CO_2$, however, the addition of 5% carbon dioxide produces an extension of tolerance to hypoxia. The addition of carbon dioxide to 8 vol % oxygen appears to be equivalent to a 10 vol % oxygen atmosphere without carbon dioxide.

The combination of animal and prior human research cited indicates the existence of interactions of oxygen, carbon dioxide, brain circulation, brain oxygenation and conscious activity. The interactions enable the addition of carbon dioxide to an atmosphere which is itself too low in oxygen concentration to sustain useful consciousness to improve the degree of brain oxygenation without increase in atmospheric oxygen concentration.

The sequence of interacting events initiated by a decrease in atmospheric oxygen concentration, as studied in human beings (or partial pressure) includes (a) fall in pulmonary and arterial blood oxygen partial pressure, (b) hypoxic stimulation of respiration by the "carotid body chemoreceptors", (c) a lowering blood, (d) a partial counteracting of the respiratory stimulation induced by the hypoxia, (e) a partial dilation of brain blood and (f) a partial counteraction of the improved brain blood flow, due to the constrictor effect of the lowered arterial carbon dioxide.

The result of this sequence without added atmospheric carbon dioxide is a stable decrease in brain oxygenation, with decrease of brain metabolism and impairent of consciousness if the level of inspired oxygen is low enough.

When non-toxic increase of carbon dioxide are included in the hypoxic atmospheric gas, a further sequence results including: (a) an increase in carbon dioxide partial pressure of lungs and arterial blood, (b) further increase in respiration due to stimulation of respiratory mechanisms by carbon dioxide, (c) an improvement in lung and arterial blood oxygen concentration resulting from the increased respiration, (d) a further dilation of brain blood vessels due to action of carbon dioxide, resulting in oxygenation and improvement in brain metabolism, and (e) restoration of consciousness.

The desired result is flame extinguishment, with the maintenance of awareness and capability for the conscious, purposeful mental and physical activity required for escape or participation in rescue.

The sequence of physiologic mechanisms are relevant to the full range of atmospheric oxygen and carbon dioxide concentrations cited for this application. It is recognized that, with more extreme states of hypoxia and/or more extreme states of carbon dioxide inhalation, prominent adverse effects of the severe hypoxia and/or hypercapnia will result in spite of the existence of the useful mechanisms outlined.

Therefore, these determinations support the premise then that the use of an atmosphere having a oxygen concentration in the range of 8–15 vol %, preferably 10–12 vol %, and a carbon dioxide concentration in the range of 2–5 vol % will extinguish fires and yet sustain life; not only sustain life, but promote consciousness and mental acuity at low oxygen levels. As can be seen, the present invention provides a viable alternative with a major improvement to fire prevention and extinguishment of fires in confined areas.

Although the present invention has been described with respect to several specific embodiments thereof, these embodiments should not be seen as a limitation on the present invention, the scope of which should be determined by the following claims.

We claim:

1. A method for controlling and extinguishing fires in a confined air-containing space while maintaining the confined space habitable for mammalian life, in particular, human life comprising introducing in the event of a fire into the confined space an effective amount of an extinguishing gas comprising carbon dioxide and an inert gas which is not toxic itself nor will decompose at combustion temperatures to produce toxic gases so as to lower the oxygen content of the confined space from its initial ambient concentration to an amount which does not support combustion, however, does support life and increase the carbon dioxide content of the confined space from its initial ambient concentration to an amount which increases brain blood flow and brain oxygenation, thereby sustaining consciousness without producing incapacitating dyspnea.

2. The process of claim 1 wherein said inert gas is selected from the group consisting of nitrogen, helium or mixtures thereof.

3. The process of claim 1 wherein said oxygen content of the confined space is lowered to a concentration in the range from 8 to 15 percent by volume.

4. The process of claim 1 wherein said oxygen content of the confined space is lowered to a concentration in the range from 10 to 12 percent by volume.

5. The process of claim 1 wherein the carbon dioxide content of the confined space is increased to a concentration in the range from 2 to 5 percent by volume.

6. The process of claim 1 wherein the extinguishing gas further comprises a polyatomic gas having a high heat capacity.

* * * * *